United States Patent [19]

Yarp

[11] 4,164,376

[45] Aug. 14, 1979

[54] MULTIPLE PATH PAPER FEED SYSTEM FOR A PRINTER

[75] Inventor: Russel E. Yarp, Mt. View, Calif.

[73] Assignee: Dataproducts Corporation, Woodland Hills, Calif.

[21] Appl. No.: 860,750

[22] Filed: Dec. 15, 1977

[51] Int. Cl.[2] ..... B41J 15/04

[52] U.S. Cl. ..... 400/642; 400/603; 400/616.2

[58] Field of Search ..... 226/91, 110; 101/232; 271/9; 400/595, 603, 605, 611, 613–613.3, 607.2, 616–616.3, 642

[56] References Cited

U.S. PATENT DOCUMENTS

| | | | |
|---|---|---|---|
| 346,910 | 8/1886 | Hawkins | 271/9 X |
| 1,096,027 | 5/1914 | Farnham | 400/603 X |
| 3,070,204 | 12/1962 | Bradshaw | 400/613.2 X |
| 3,625,333 | 12/1971 | Cortona et al. | 400/603 |
| 3,753,483 | 8/1973 | Lundquist et al. | 400/616.1 X |
| 3,941,051 | 3/1976 | Barrus et al. | 400/616.1 X |
| 4,074,797 | 2/1978 | Lewis et al. | 400/124 |

FOREIGN PATENT DOCUMENTS

| | | | |
|---|---|---|---|
| 2511983 | 9/1976 | Fed. Rep. of Germany | 400/613.2 |

*Primary Examiner*—Paul T. Sewell

[57] ABSTRACT

In a high speed printer, a system is provided for permitting paper feed optionally through openings at the front, bottom and rear of the printer housing. First and second spaced parallel arcuate rear guide members define a rear guideway leading paper from the rear opening to the front of the printer platen. Third and fourth spaced arcuate guide members define another paper guideway from the front opening; these front guide members terminate at a position forward of the frontmost plane of the rear guide members. A downwardly extending paper guideway, facilitating entry of paper from the bottom opening, is defined between the terminal portions of the front and rear guide members.

4 Claims, 3 Drawing Figures

REAR FEED
BOTTOM FEED
FRONT FEED
11R
11B
11F
11E
10
11
12
13
13a
13b
14
15
16
27
28
29
34
34a
35
35a
35b
35c
35d
36
36a
37
37a
37b
37c
37c'
38
38a
39

MULTIPLE PATH PAPER FEED SYSTEM FOR A PRINTER

BACKGROUND OF THE INVENTION

1. Field of the Invention

The present invention relates to a multiple path paper feed system for a printer.

2. Description of the Prior Art

High speed printers of the type used with computers or data processors often are used to print out large amounts of data. This necessitates a continuous flow of paper to the printer, so that the data output can be obtained without stopping often to insert a new page. Typically, the paper is supplied continuously from a zig-zag folded stack, or from a roll. In either case, the stack or roll is mounted externally to the printer itself.

In the past, printers have been configured only to accept paper from a single entryway, usually below the printer. This limited the flexibility of the printer, requiring it always to be mounted on a pedestal or other support having a pathway communicating to the bottom paper feed. This arrangement also required physical positioning of the source paper stack or roll within the pedestal or mounting, below the printer.

Clearly, such arrangement does not permit mounting of the printer in a situation where no room is available beneath the printer to store the paper supply, or in which access to such area is difficult, thereby making it uncomfortable or inconvenient for the operator to replace the paper source. An object of the present invention is to provide a printer paper feed mechanism which permits paper to be fed optionally from the front, bottom or rear of the printer housing. This results in considerable flexibility as to where and how the printer can be mounted, and permits installation of the printer and location of the feed paper source in a position that is most comfortable and convenient for operator replacement.

SUMMARY OF THE INVENTION

These and other objectives are achieved by providing a data printer having a multiple path paper feed system that permits optional entry of the paper from the front, bottom or rear of the printer housing. To this end, the printer includes a first paper guideway extending downwardly from the front of the printer platen to an opening in the bottom of the printer housing. This guideway allows unimpeded entry of paper from below the printer.

Two other arcuate paper guideways are provided which extend respectively from horizontal openings at the front and rear of the printer housing. Each such guideway is smoothly, arcuately, upwardly curved, and terminates through an opening communicating into the downwardly extending guideway. Paper introduced through either of these arcuate guideways thus is curved upwardly and reaches the platen via the end portion of the guideway leading from below the housing.

BRIEF DESCRIPTION OF THE DRAWINGS

A detailed description of the invention will be made with reference to the accompanying drawings wherein like numerals designate corresponding parts in the several figures.

FIG. 3 is a transverse sectional view along the line 3—3 of FIG. 2, showing the three alternate paper guideways.

DESCRIPTION OF THE PREFERRED EMBODIMENT

The following detailed description is of the best presently contemplated mode of the carrying out the invention. This description is not to be taken in a limiting sense, but is made merely for the purpose of illustrating the general principles of the invention since the scope of the invention best is defined by the appended claims.

Figures 1, 2:
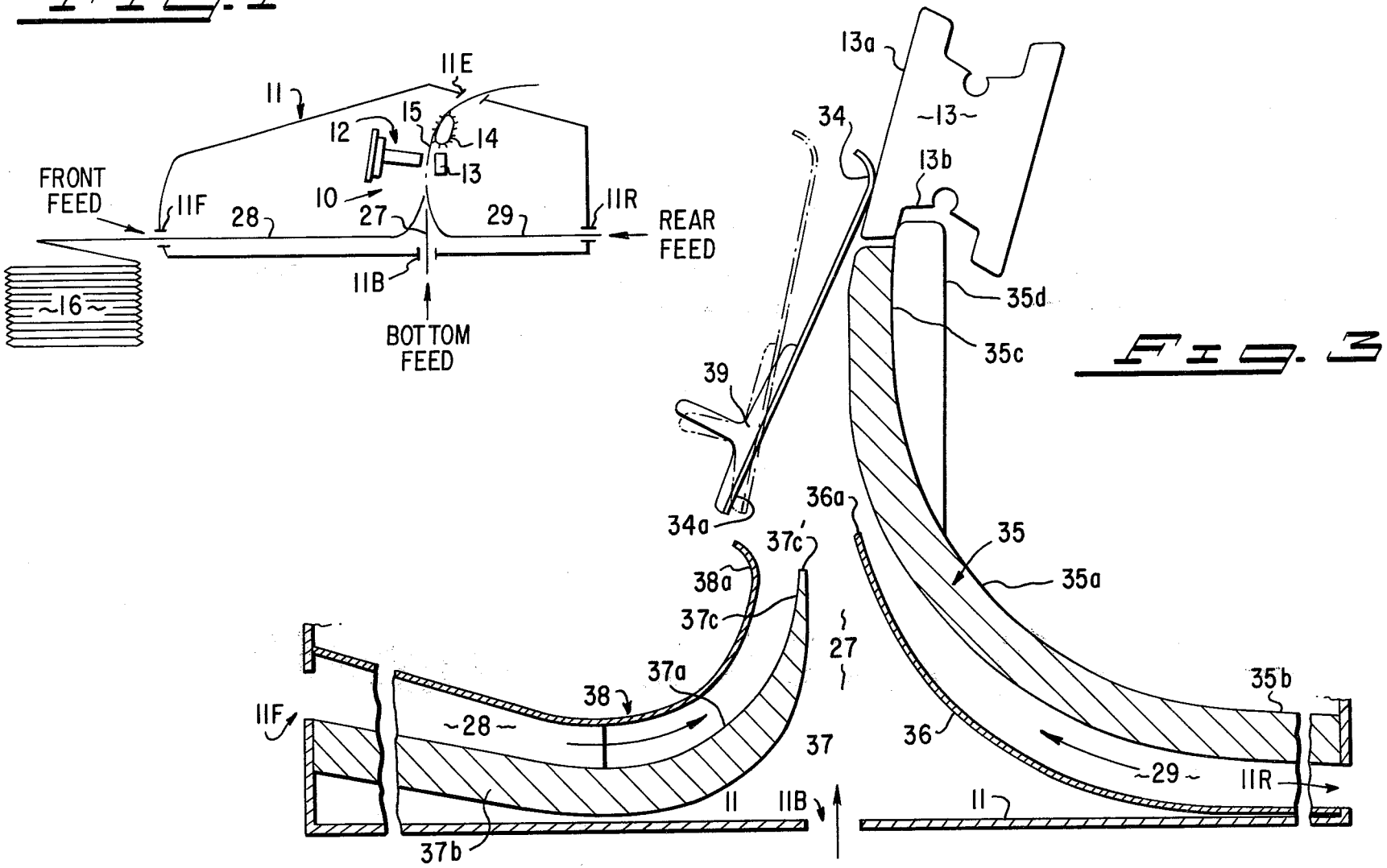
FIG. 1 is a simplified diagrammatic view showing the front, bottom and rear feed paths to a printer, in accordance with the present invention.
FIG. 2 is a perspective view of a portion of the printer of FIG. 1, the view being cut away and sectioned so as to show the multiple path paper feed arrangement.
Figure 2:
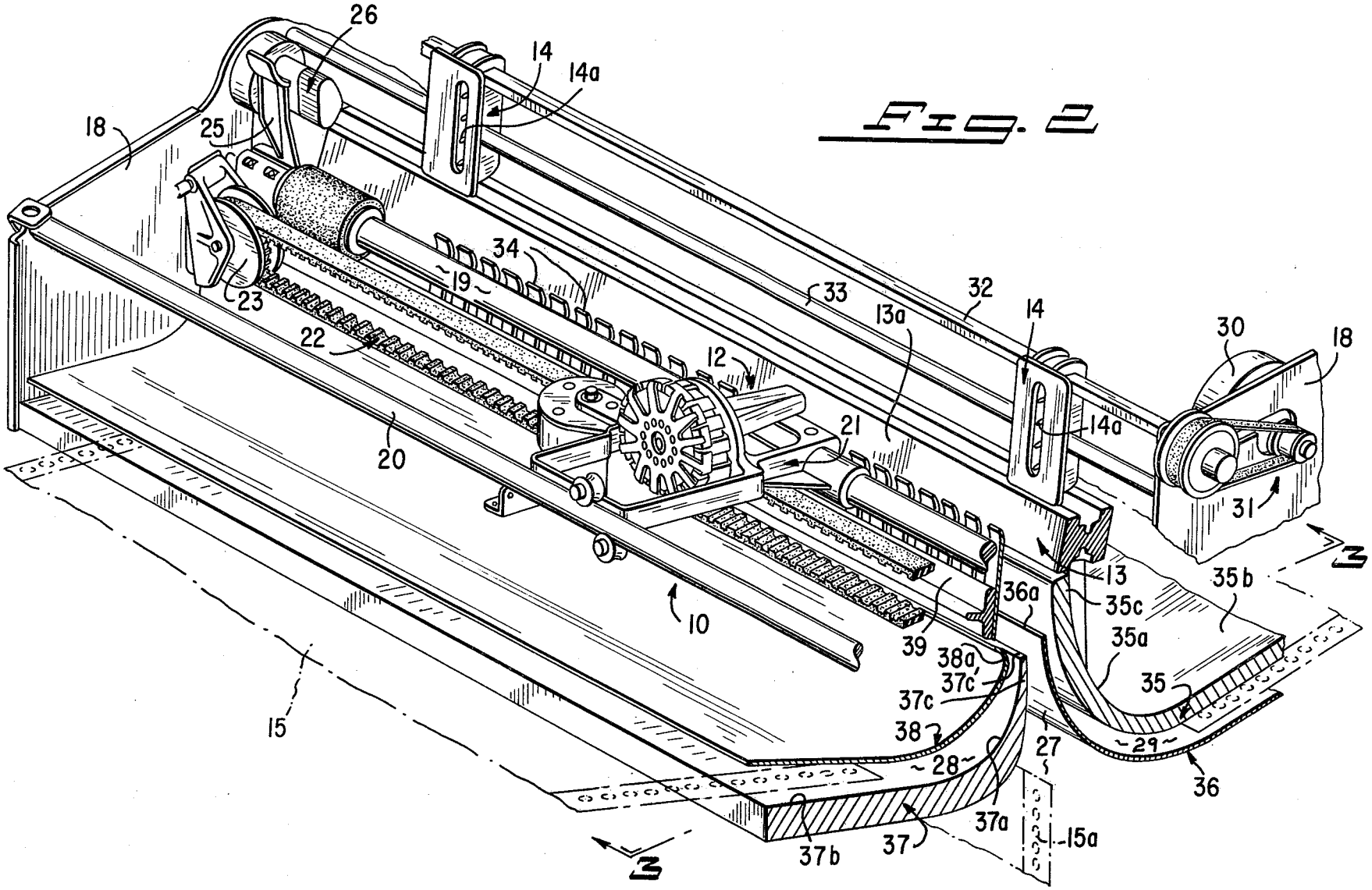

A simplified view of the inventive multiple path paper feed system is shown in FIG. 1. There, the printer 10 is contained in a case or housing 11 and includes a print head 12, a platen 13, and a paper tractor 14. In accordance with the present invention, paper 15 from a stack 16 or other source is supplied to the printer 10 optionally via an opening 11F in the front of the case 11, an opening 11B in the bottom or an opening 11R in the rear of the case 11. In each instance, the paper 15 is guided to the space between the platen 13 and the print head 12 so as to enable printing thereby. The tractor 14 advances the paper 15 as required, and drives the paper out of the housing via an exitway 11E. Although the paper stack 16 is shown at the front of the housing 11, this, of course, is not necessary. In accordance with the present invention, the paper source may be located below or behind the housing 11 so as to accommodate paper feed through the bottom or rear entryway 11B or 11R.

Details of the inventive multiple path paper feed system are shown in FIGS. 2 and 3. Mounted within the housing 11 is frame 18 which supports the platen 13 and other components of the printer 10. Thus, the frame 18 also supports a shaft 19 and a rod 20 along which a print head carriage 21 is driven via a belt 22, a pulley 23 and a motor (not shown). This arrangement enables the print head 12, which is mounted on the carriage 21, to be transported across the page being printed, so as to accomplish character by character printing one line at a time.

Although the invention is not so limited, the print head 11 may comprise a dot matrix print head of the type disclosed in the copending U.S. application, Ser. No. 805,706 which is assigned to the same assignee as the present invention. Such a device accomplishes printing by impacting a carbon ribbon (not shown) against the paper 15 and the platen 13. Adjustment of the gap between the head 12 and the platen 13 may be accomplished by a mechanism which forms no part of the present invention, but which is disclosed in the copending U.S. patent application entitled PLATEN GAP ADJUSTER, Ser. No. 853,346 which is assigned to the same assignee as the present invention. This mechanism uses a lever arm 25 and associated cam action knob 26 to accomplish the gap adjustment.

In accordance with the present invention, three guideways are provided to direct paper to the space between the print head 12 and the platen 13. These include a downwardly extending guideway 27 which allows unimpeded entry of paper from below the case 11 through the bottom opening 11B to the platen 13, a rearwardly extending arcuate guideway 28 leading from the front opening 11F and a forwardly extending arcuate guideway 29 leading from the rear opening 11R. Paper fed through any of these three guideways 27, 28, 29 is directed past the front face 13*a* of the platen 13 to the tractors 14. Each tractor 14 includes a sprocket chain 14*a* which engages the edge holes 15*a* of the paper 15. The sprocket chains 14*a* are driven by a motor 30, a belt and pulley assembly 31 and a shaft 32 so as to advance the paper 15 after each line has been printed. A stationary shaft 33 affixed to the frame 18 provides additional support for the tractors 14. A set of leaf spring fingers 34 tension the paper 15*a* against the platen 13.

The rear paper guideway 29 is defined by first and second generally planar guide members 35, 36 which extend forwardly from the rear opening 11R. The guide member 35 has a smoothly arcuate section 35*a* extending between a generally horizontal rear portion 35*b* and a vertical terminal portion 35*c* having a front face that is aligned with the front face 13*a* of the platen 13. A tab 35*d* projects into a channel 13*b* at the bottom of the platen 13 to aid smooth alignment between the end 35*c* of the guide member 35 and the platen face 13*a*.

The guide member 36 has an arcuate cross-section that is generally conformal with the guide member 35, and is mounted beneath and in generally spaced parallel relationship with the member 35. The forward edge 36*a* of the guide member 36 terminates at a position that is aligned with or behind a plane depending from the front face 13*a* of the platen 13. With this arrangement, paper 15 introduced through the rear opening 11R will be guided between the members 35 and 36 to a position just below the platen 13. From there, the paper will be guided by the fingers 34 past the platen 13 to the tractors 14.

The front guideway 28 is defined by a pair of generally planar guide members 37 and 38. The member 37 has a smoothly arcuate section 37*a* extending between a forward planar section 37*b* which leads from the front opening 11F and a generally vertical terminal portion 37*c*. The terminal section 37*c* is of reduced thickness, and does not extend rearward of a vertical plane that is spaced forward of the frontmost projection of the guide members 35 and 36. In this way, the guide member 37 does not interfere with the free entry of paper via the downward guideway 27. The terminal edge 37*c'* of the guide member 37 advantageously is situated slightly lower than the terminal edge of the guide member 36.

The guide member 38 approximately conforms to the curvature of the member 37, and is mounted in spaced parallel relationship above that member. In the embodiment illustrated in FIGS. 2 and 3, the front face 13*a* of the platen 13 is tilted slightly rearward. The terminal section 38*a* of the guide member 38 is tangential to a plane extending downwardly from the platen front face 13*a*. With this arrangement, paper introduced through the guideway 28 will emerge into the upper portion of the guideway 27 and will be directed toward the platen 13.

The guideway 27 from the bottom opening 11B generally is defined by the front of the vertical portion 35*c* of the guide member 35, by the terminal section 36*a* of the guide member 36 and by the terminal portion 37*c* of the guide member 37. The curvatures and relative spacing of these members define the guideway 27 and act to guide paper introduced through the bottom opening 11B upwardly to the face of the platen 13.

During paper insertion, the tensioning fingers 34 can be retracted away from the platen 13. To this end, the lower end 34*a* of each finger 34 is attached to a bar 39 which extends across the printer 10 below the shaft 19. The lever 25 (FIG. 2) is coupled to this bar 39 so as to rotate the bar to the position shown in phantom in FIG. 3 when the lever 25 is rotated away from the knob 26. Space thus is provided for paper insertion.

What is claimed is:

1. A data printer for a computer or data processing system having a housing with front, rear and bottom openings for optional entry of paper, the improvement for facilitating paper feed to said printer from optional alternate locations, comprising:

a first paper guideway extending downwardly from the front of the platen of said printer, said first guideway allowing unimpeded entry of paper from below said printer to said platen, and at least one arcuate paper guideway extending from a location external to said printer and lateral of said platen, said arcuate guideway curving upwardly and opening into said downwardly extending guideway so as to allow unimpeded entry of paper from said external location via said arcuate guideway and the upper portion of said downwardly extending guideway to said platen, said arcuate guideway comprising first and second spaced generally parallel arcuate rear guide members defining a rear arcuate guideway for directing paper fed through said rear opening to the front of said platen, third and fourth spaced arcuate front guide members defining a front arcuate guideway for directing paper fed through said front opening to said platen, the forward end portions of said first and second guide members being spaced from the rearward end portions of said third and fourth guide members so as to define therebetween said downwardly extending first guideway, said bottom opening leading to said first guideway.

2. A data printer according to claim 1 wherein the front face of said platen is tilted rearwardly, and wherein said third and fourth arcuate guide members terminate at a rear opening facing a plane extending downwardly and forwardly from said platen front face.

3. A multiple path paper feed system for a printer of the type that uses paper continuously fed from a source comprising:

a case for said printer, a frame contained with said case, and a platen mounted to said frame, a paper being fed past said platen during printing, a first generally planar guide member attached to said frame and having a smoothly arcuate cross-section extending from a horizontal opening at the rear of said case to a vertical position aligned with the front face of said platen, a second generally planar guide member having a smoothly arcuate cross-section conformal with said first guide member and being mounted to said frame in spaced generally parallel relationship below said first guide member so as to define therebetween a rear paper entryway from the rear of said case to said platen, the forward edge of said second guide member terminating at a position that is not forward of a plane depending from the frontal face of said platen, a third generally planar guide member attached to said frame and having a smoothly arcuate cross-section extending from a horizontal opening at the front of said case to a vertical position below said platen and spaced forwardly of a vertical plane depending from the frontmost extension of said first and second guide members, and a fourth generally planar guide member having an arcuate cross-section and being mounted to said frame in spaced relationship above said third planar guide member so as to define therebetween a front paper entryway from the front of said case to said platen, and an opening in the bottom of said case below said platen to facilitate paper entry from below said case through said bottom opening and through the space forward of said vertical plane depending from the foremost extension of said first and second guide members and rearward of the rearmost extension of said third and fourth guide members.

4. A multipath paper feed system according to claim 3 wherein the front face of said platen is tilted rearwardly and wherein the rear terminal portion of said fourth guide member is situated tangential to a plane projecting forwardly and downwardly from said platen front face.

* * * * *